United States Patent [19]

Saligny

[11] 4,060,302

[45] Nov. 29, 1977

[54] CONNECTOR ADAPTED TO GRIP ELECTRIC CONDUCTORS

[75] Inventor: Yves Saligny, Cluses, France

[73] Assignee: Etablissements Carpano & Pons, France

[21] Appl. No.: 731,011

[22] Filed: Oct. 8, 1976

[30] Foreign Application Priority Data

Oct. 27, 1975 France ..... 75.33486

[51] Int. Cl.[2] ..... H01R 13/38

[52] U.S. Cl. ..... 339/97 R

[58] Field of Search ..... 339/97–99

[56] References Cited

U.S. PATENT DOCUMENTS 2,694,189 11/1954 Wirsching ..... 339/97 R 4,002,391 1/1977 Dunn et al. ..... 339/98

FOREIGN PATENT DOCUMENTS 1,264,562 3/1968 Germany ..... 339/97 R

*Primary Examiner*—Joseph H. McGlynn

*Attorney, Agent, or Firm*—Robert E. Burns; Emmanuel J. Lobato; Bruce L. Adams

[57] ABSTRACT

A connector for the connection of electrical conductors of relatively small section, of the type comprising a flat conducting element in which there is a gripping slot of relatively small width in relation to the thickness of the flat element. This slot being adapted to receive and grip at least one conductor. The flat element is formed of two or more flat pieces disposed in piled configuration against one another and rigidly connected to one another, possibly by integral bridge portions formed by folding a flat band. Each flat piece has a narrow slot which is not substantially wider than the thickness of the piece, these narrow slots being aligned to form the gripping slot.

10 Claims, 9 Drawing Figures

CONNECTOR ADAPTED TO GRIP ELECTRIC CONDUCTORS

BACKGROUND OF THE INVENTION

The invention concerns connectors for connecting, possibly with prior stripping of an insulating sheath, electrical conductors of relatively small cross-section, of the type having a flat conducting element in which there is provided at least one gripping slot or relatively small width in relation to the thickness of the flat element. This slot is adapted to receive at least one conductor.

In known connectors of this type several operations are necessary to obtain a gripping slot of the desired with. French Pat. No. 2,072,627, for example, describes a method of providing such a relatively narrow slot in which, firstly, a part of the flat element is stamped and folded out to leave an opening with two facing walls; in a second step, a first of these walls is cut away to provide a first wall of the gripping slot, then in a third step the folded part is brought back to its initial position in the plane of the flat element to form the second wall of the gripping slot. Each of the walls of the gripping slot is thus provided by a distinct operation with a distinct tool. It follows that the width of the slot may, as a result of the manufacturing tolerances involved in operation of the tools, vary for example by plus or minus three or four hundredths of a millimeter. Such variations would be inacceptable when the slot has a width of the order of 0.2 millimeter, since they correspond to plus or minus 15 or 20% of the width. As a result, with slots provided in this way, there may be important variations in the gripping of a gripped conductor.

French Pat. No. 2,058,993 also describes a connector of this type formed of two superposed flat plates, one wall of each gripping slot being formed by one plate and the other wall by the other plate. This device also involves the previously mentioned drawback, namely relatively great possible variations of the width of the slot due to machining tolerances.

SUMMARY OF THE INVENTION

An aim of the invention is to provide a connector of the stated type which is not subject to the stated drawbacks.

A connector according to the invention comprises a flat element formed of at least two flat pieces disposed in piled configuration against one another and rigidly connected to one another, each piece having a narrow slot which is not substantially wider than the thickness of the piece, said narrow slots of the flat pieces being aligned to form the gripping slot of the flat element.

Such connectors may be manufactured with the width of the gripping slot provided to close tolerance, since the two sides of each narrow slot forming the gripping slot may be provided in a single operation by a single tool. The gripping member according to the invention also enables a multiplication of point contacts between the flat element and a gripped conductor, thus providing an improved electrical contact. Certain embodiments of the connector may, without an increase in its thickness, receive, simultaneously or separately, conductors of different sections, and may include retaining means for the conductor or conductors in their slot or respective slots. Likewise, it is possible, without the thickness of the flat element being increased, for the insertion of a conductor and possibly its automatic prior stripping of an insulating sheath to be carried out in several successive steps, which facilitates insertion since the effort to be exerted on the conductor at each instant is reduced. Also, it is possible to limit the deformation of the walls of each of the narrow aligned slots without it being necessary to provide an additional element for this purpose.

According to one embodiment, the aligned narrow slots have the same width or approximately the same width; according to another embodiment, at least one of the narrow aligned slots is slightly wider than the other narrow aligned slot(s), the gripping slot being adapted to receive a conductor of given section. In yet another embodiment, at least one of the narrow aligned slots is wider that the other aligned slot(s), the gripping slot being adapted to receive conductors of different section.

In any of aforementioned embodiments, a lead-in end of at least one of the narrow aligned slots forming the gripping slot of the flat element is staggered in relation to a lead-in end of the other slot(s), along the longitudinal axis of the gripping slot; when these slots have different widths, the lead-in end of the wider slot(s) extends beyond the narrower slots in a direction away from the bottom of said slots.

The gripping members advantageously have means at least partially obturating the gripping slot for retaining a conductor or conductors in the gripping slot. These retaining means are resiliently deformable relative to the adjacent flat piece(s) in a direction transverse to the gripping slot.

Advantageously, some of the flat pieces forming the flat element are connected to each adjacent flat piece by an integral bridge portion formed by folding a flat band. The connector is thus advantageously provided by folding a band having pre-cut slots, the successive folds possibly being made in opposite directions to provide a pleat-like configuration, or by successively folding the band in the same direction to wind it about itself. The piled flat pieces may also be connected in other manners, for example by welding, riveting, sticking, or over-moulding; they may even be connected together for example at only one end by a common holding element in which they are force-fitted or over moulded. When the connector is formed of a flat band folded in pleat-like configuration, the aforesaid retaining means of the conductor(s) is advantageously supported by an end part of the band connected it to the adjacent flat piece by a resiliently deformable bridge portion.

The connector may have means for limiting the deformation of the walls of the slots of at least some of the piled flat pieces; such means may be an integral part of the respective flat piece in the form of a loop connecting the opposite walls of each slot in the proximity of the opening thereof.

BRIEF DESCRIPTION OF THE DRAWINGS

Embodiments of the invention are shown, by way of example, in the accompanying drawings, in which.

DESCRIPTION OF THE PREFERRED EMBODIMENTS

Figure 1:
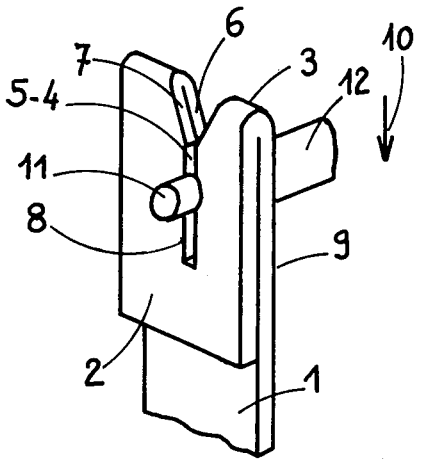
FIG. 1 is a perspective view of a first embodiment of connector gripping a conductor.

The connector shown in FIG. 1 comprises two flat conducting pieces 1 and 2 placed flat against one another and connected at one end by integral bridge portions 3. The piece 1 is longer than piece 2 and serves for example for securing the connector on a support, not shown. The flat pieces 1 and 2 have respective aligned slots 4 and 5 of the same width. The slots 4 and 5 are extended by aligned conical notches 6 and 7 flaring out centrally into the end formed by bridge portions 3. The two slots 4 and 5 have for example a width of 0.2 millimeter, and the flat band forming pieces 1 and 2 a thickness of 0.2 millimeter. The two aligned slots 4 and 4 thus form a gripping slot 8 of 0.2 millimeter width provided in a flat element 9 0.4 millimeter thick, this element being formed by the two piled flat pieces 1 and 2. The connector is formed by folding, about the bridge portions 3, a flat band in which the slots 4 and 5 and the conical notches 6 and 7 have been pre-cut.

An insulated conductor 11 can be inserted in this connector by forcing it in the direction of arrow 10 in the gripping slot 8; in a first phase, the conical slots 6 and 7 shear the insulating sheath 12 surrounding the conductor 11. In a second phase the conductor 11 itself is elastically deformed to the width of the slot 8 in which it is gripped.

Figure 2:
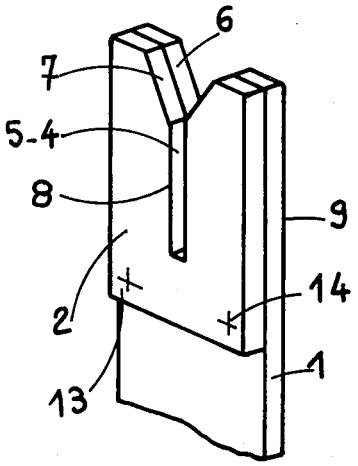
FIG. 2 is a perspective view of a variation of the first embodiment.

FIG. 2 shows a variation of the connector of FIG. 1 in which the bridge portions 3 are dispensed with, the flat pieces 1 and 2 being rigidly connected by two weld points 13 and 14. The other characteristics of this connector are identical to those of FIG. 1 and it is used in the same manner.

Figure 3:
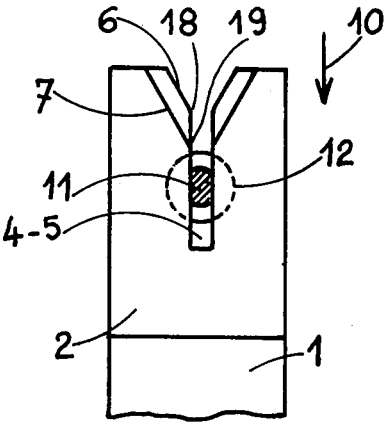
FIG. 3 is an elevational view of a second embodiment of connector gripping a conductor.

FIG. 3 shows a second embodiment of a connector, similar to that of FIG. 1, but in which a lead-in end 18 of slot 4 is staggered in relation to a lead-in end 19 of the slot 5 along the longitudinal axis of the slots, the notches 6 and 7 being offset in the same direction. The purpose of this staggering is to facilitate forcing in of the conductor 11 and its insulating sheath 12. During insertion, both the shearing of the insulator and the forcing in of the conductor 11 are carried-out in two phases, the effort required for this forcing thus being reduced, as well as the risk of breaking the conductor, which is particularly interesting when the conductor has a very small section.

Figure 4:
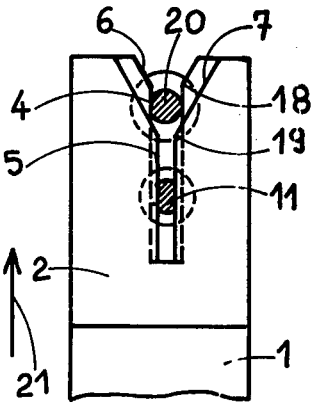
FIG. 4 is an elevational view of a third embodiment of connector gripping two conductors.

FIG. 4 shows a third embodiment in which one of the narrow aligned slots, slot 4, is wider than the slot 5. The lead-in end 18 of the slot 4 is, as in FIG. 3, staggered in relation to the lead-in end 19 of slot 5, in direction 21, i.e. facing out from the bottom of these slots. The notches 6 and 7 are also offset in direction 21. This staggering and the difference of width of slots 4 and 5 permits the simultaneous or non-simultaneous forcing in of two conductors 11 and 20 of different sections. Hence, the conductor 11 may be forced in the slot 5 and conductor 20 in the end part of slot 4 adjacent its lead-in end 18 which extends beyond the narrower slot 5. It is observed that, as each conductor is gripped in a distinct flat piece, the gripping of one is not disturbed by gripping of the other.

The width of slot 4 could be only slightly greater than that of the slot 5; it may for example have a width of 0.25 millimeter and the slot 5 a width of 0.20 millimeter, these widths being adapted to receive a conductor of the same section. This will enhance the advantage of the embodiment of FIG. 3 and a progressive forcing in of the conductor will be possible. Thus, in a first step, the conductor is inserted in the end part of slot 4 adjacent the lead-in end 18 then, in a second step, in the gripping slot defined by the overlying slots 4 and 5.

In other embodiments, slots 4 and 5 may have slightly different widths without the lead-in ends 18 and 19 of these slots, or the corresponding notches 6 and 7, being staggered.

Figure 5:
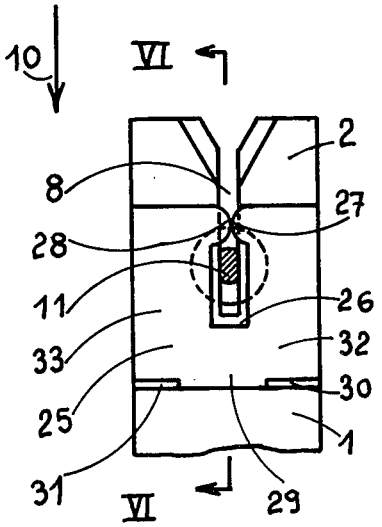
FIGS. 5 and 6 are respectively an elevational view and a cross-section along line VI—VI of FIG. 5, of a variation of the second embodiment of connector gripping a conductor.
Figure 6:
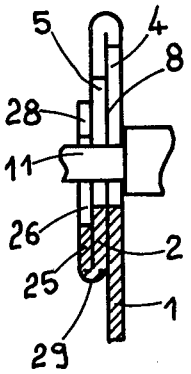

The connector shown in FIGS. 5 and 6 includes a flat element formed of piled flat pieces one of which includes means for retaining a conductor 11 in the gripping slot 8. Thus, a flat piece 25, which lies on the flat piece 2, has a slot 26 wider than the aligned slots 4 and 5 forming the gripping slot 8, and two rounded parts 27 and 28 disposed facing one another and at least partially obturating the gripping slot 8. A bridge portion 29 which connects the flat piece 25 to the adjacent flat piece 2 has cut-outs 30 and 31 which reduce its width and leave portions 32,33 providing a resilient coupling between the parts 27,28 and portion 29. These parts 27 and 28 are hence movable transverse to the slots, against the resilient action of portions 32 and 33. The other elements are in this example identical to those of the embodiment of FIG. 3. When the conductor 11 is inserted in the direction of arrow 10, it firstly causes a spacing apart of the two parts 27 and 28, which then spring together when the conductor 11 occupies the position shown in FIGS. 5 and 6. This embodiment is particularly interesting when the conductor 11 is a multi-strand conductor, since the parts 27 and 28 maintain all of the strands together against one another, which enables the gripping of the conductor to be maintained.

Figure 7:
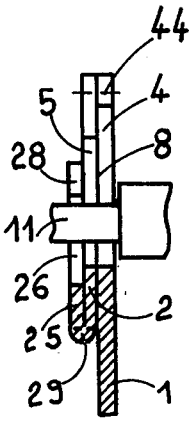
FIG. 7 is a cross-section similar to FIG. 6 showing a variation of the connector of FIGS. 5 and 6.

FIG. 7 shows a variation of the preceding embodiment in which the three flat pieces 1,2 and 25 are no longer formed from a single band successively folded in opposite directions in a pleat-like configuration, but are formed of two separate pieces, namely a flat piece 1, and a folded piece forming the pieces 2 and 25. Weld points 44 hold the pieces 1 and 2 of the connector assembled.

Figure 8:
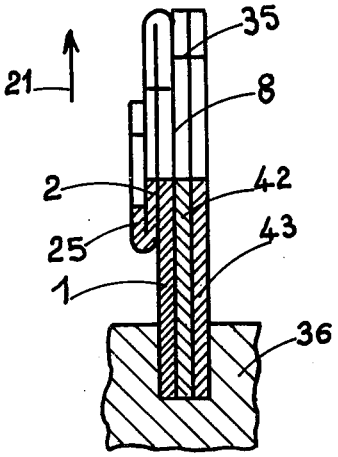
FIG. 8 is a cross-section showing another variation of the connector of FIGS. 5 and 6.

The varied embodiment of FIG. 8 includes a folded element similar to that of FIGS. 5 and 6, and two further flat pieces 42 and 43 having a lead-in end 35 staggered in direction 21 in relation to the lead-in end of the pieces 1 and 2. The piled flat pieces 1,42 and 43 are connected to one another at one end by a common holding element 36 in which they are for example force-fitted. This connector is used in a similar manner to the previously described connectors.

Figure 9:
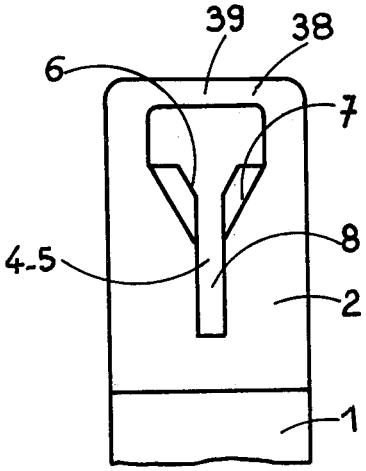
FIG. 9 is an elevational view of another embodiment of connector.

FIG. 9 shows a modification of, for example, the second embodiment provided with superposed loops 38 and 39 respectively forming part of the flat pieces 1 and 2. These loops connect the two walls of each slot 4 and 5 in the proximity of the lead-in opening thereof. The loops 38 and 39 thus form means for limiting the deformation of the walls of the slots 4 and 5, when the conductor is forced in the gripping slot 8. Each loop thus forms an integral part of the respective flat piece which includes the slot, and does not require any supplementary supporting piece.

Connectors according to the invention are particularly useful in instances when one must grip a conductor of small section. One interesting application is the connection of subscriber lines to a cable head of a lead-in distributor

What is claimed is:

1. A connector for the connection of electrical conductors of relatively small cross-section, of the type comprising a flat conducting element in which there is a gripping slot of relatively small width in relation to the thickness of the flat element, said slot being dimensioned to receive and grip at least one conductor, wherein the flat element is formed of two flat pieces disposed in piled configuration against one another and rigidly connected to one another, each piece having a narrow slot which is not substantially wider than the thickness of the piece, said narrow slots of the flat pieces being aligned to form the gripping slot of the flat element.

2. A connector according to claim 1, in which the narrow aligned slots forming the gripping slot of the flat element are all of the same width.

3. A connector according to claim 1, in which one of the narrow aligned slots forming the gripping slot of the flat element is slightly wider than the other narrow aligned slot, the gripping slot being dimensioned to receive a conductor of given cross section.

4. A connector according to claim 1, in which each of the flat pieces has a flared notch opening extending the narrow slot, each said flared notch opening defining a guide for inserting a conductor in the gripping slot, at least one of the flared openings being staggered in relation to the other.

5. A connector according to claim 1, in which at least one of the narrow aligned slots forming the gripping slot of the flat element is wider than the other narrow aligned slot, said gripping slot being dimensioned to receive conductors of different cross section.

6. A connector according to claim 5, in which said wider aligned slot extends beyond said other aligned slot along a direction away from a bottom end of said slots.

7. A connector according to claim 1, in which said flat element comprises at least one flat piece having means at least partially obturating the width of said gripping slot for retaining a conductor in said gripping slot, said retaining means being resiliently deformable relative to the adjacent flat piece in a direction transverse to the gripping slot.

8. A connector according to claim 7, in which said retaining means is formed by an end part of a folded band, said end part being connected to an adjacent flat piece by an integral resiliently deformable bridge portion.

9. A connector according to claim 1, in which at least some of the flat pieces forming the flat element are connected to each adjacent flat piece by an integral bridge portion formed by folding a flat band.

10. A connector according to claim 9, in which said flat band is successively folded in opposite directions in a pleat-like configuration.

* * * * *